US008879956B2

(12) United States Patent
Sasaki et al.

(10) Patent No.: US 8,879,956 B2
(45) Date of Patent: Nov. 4, 2014

(54) INTERMEDIATE TRANSFER DEVICE AND IMAGE FORMING APPARATUS INCLUDING FRAME MEMBERS

(75) Inventors: Hibiki Sasaki, Kanagawa (JP); Akihiro Ouchi, Kanagawa (JP); Hirofumi Goto, Kanagawa (JP); Hiroaki Yagi, Kanagawa (JP); Kenji Suzuki, Kanagawa (JP); Yoshihisa Nakao, Kanagawa (JP); Ayaka Miyoshi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 189 days.

(21) Appl. No.: 13/590,911

(22) Filed: Aug. 21, 2012

(65) Prior Publication Data

US 2013/0189001 A1 Jul. 25, 2013

(30) Foreign Application Priority Data

Jan. 23, 2012 (JP) ..... 2012-010889

(51) Int. Cl.
*G03G 15/01* (2006.01)
*G03G 15/16* (2006.01)

(52) U.S. Cl.
USPC ..... 399/121; 399/302

(58) Field of Classification Search
USPC ..... 399/121, 302
See application file for complete search history.

(56) References Cited

U.S. PATENT DOCUMENTS 7,920,808 B2 * 4/2011 Ohkushi et al. ..... 399/121
2009/0263155 A1 10/2009 Murano

FOREIGN PATENT DOCUMENTS

JP 2007-069454 A 3/2007
JP 2009-258457 A 11/2009

* cited by examiner

*Primary Examiner* — William J Royer
(74) *Attorney, Agent, or Firm* — Sughrue Mion, PLLC

(57) ABSTRACT

An intermediate transfer device includes an intermediate transfer member, intermediate transfer member support members, and two frame members each including first and second positioning members each having a positioning portion. At least one of the frame members satisfies a condition L1:L2=2.85:x 0≤x≤1, where L1 is the length of a line segment connecting an intersection point to the positioning portion of one of the positioning members on a side opposite to a side toward which a line of action of a force applied by a second-transfer unit is inclined and L2 is the length of a line segment connecting the intersection point to the positioning portion of the other of the positioning members on the side toward which the line of action is inclined, the intersection point being an intersection of the line of action and a line segment connecting the positioning portions.

2 Claims, 14 Drawing Sheets

INTERMEDIATE TRANSFER DEVICE AND IMAGE FORMING APPARATUS INCLUDING FRAME MEMBERS

CROSS-REFERENCE TO RELATED APPLICATIONS

This application is based on and claims priority under 35 USC 119 from Japanese Patent Application No. 2012-010889 filed Jan. 23, 2012.

BACKGROUND (i) Technical Field

The present invention relates to an intermediate transfer device and an image forming apparatus.

(ii) Related Art

A tandem-type color printer, which is a type of an image forming apparatus, includes four image forming units, each of which including components such as a charger, a developing device, and a photoconductor drum (an example of an electrostatic latent image carrier). The four image forming units form yellow (Y), magenta (M), cyan (C), and black (K) toner images (examples of developer images).

By using a first-transfer roller, the color toner images, which have been formed by the image forming units, are transferred (first-transferred) to an intermediate transfer belt (an example of an intermediate transfer member) so as to overlap one another. By using a second-transfer roller, the toner images on the intermediate transfer belt are transferred (second-transferred) to a sheet.

Therefore, the intermediate transfer belt, to which the toner images are first-transferred, needs to keep a predetermined positional relationship with the photoconductor drum.

The intermediate transfer belt is supported by frames (examples of frame members) that are disposed on the two sides of the intermediate transfer belt in the width direction of the intermediate transfer belt so as to be rotatable in the circumferential direction with plural rollers. The intermediate transfer belt, the frames, the rollers, and other members are unitized as an intermediate transfer device.

Therefore, to keep an appropriate positional relationship between the intermediate transfer belt and the photoconductor drum, it is effective to reduce the strain in the frames of the intermediate transfer device.

SUMMARY

According to an aspect of the invention, an intermediate transfer device includes an endless intermediate transfer member to which plural developer images in different colors are transferred so as to overlap one another by a first-transfer unit; plural intermediate transfer member support members that support the intermediate transfer member so that the intermediate transfer member rotates in a circumferential direction; two frame members respectively disposed at two ends of the intermediate transfer member in a width direction of the intermediate transfer member, the two frame members supporting two ends of each of the intermediate transfer member support members; and first and second positioning members respectively disposed at two positions on each of the frame members with a distance therebetween, each of the first and second positioning members including a positioning portion that performs positioning by pressure-contacting an apparatus body when the intermediate transfer device is mounted in the apparatus body. At least one of the frame members satisfies a condition L1:L2=2.85:x ($0 \leq x \leq 1$), where L1 is a length of a line segment connecting an intersection point to the positioning portion of one of the first and second positioning members that is located on a side opposite to a side toward which a line of action of a force applied to the at least one of the frame members is inclined and L2 is a length of a line segment connecting the intersection point to the positioning portion of the other of the first and second positioning members that is located on the side toward which the line of action is inclined, the intersection point being an intersection of the line of action and a line segment connecting the two positioning portions to each other, the force being applied by a second-transfer unit that transfers the developer images on the intermediate transfer member to a recording medium by pressing one of the intermediate transfer member supporting members with the intermediate transfer member therebetween.

BRIEF DESCRIPTION OF THE DRAWINGS

An exemplary embodiment of the present invention will be described in detail based on the following figures, wherein.

DETAILED DESCRIPTION

Figure 1:
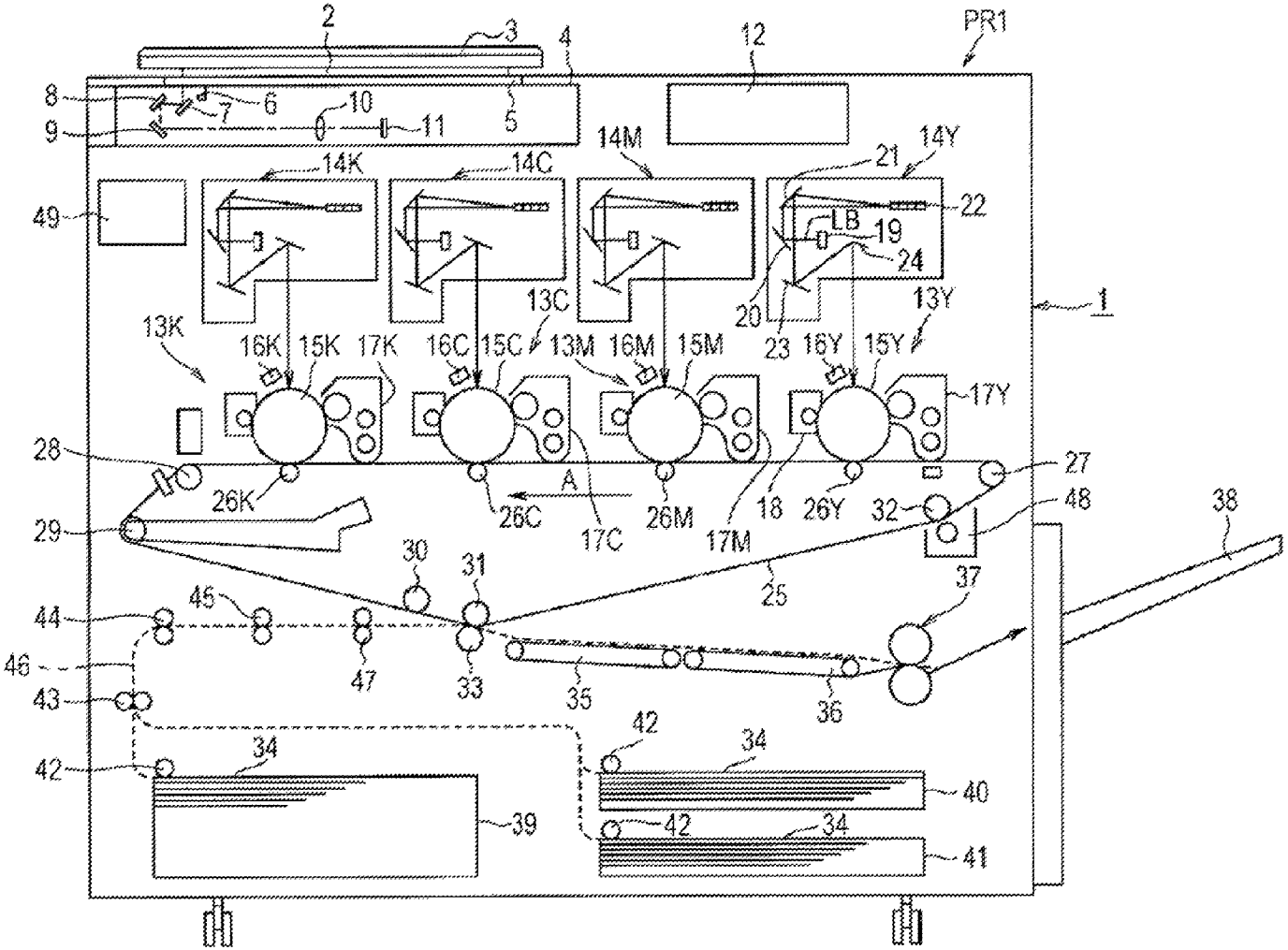
FIG. 1 is a schematic view illustrating the structure of an image forming apparatus according to the exemplary embodiment of the present invention.
Figure 2:
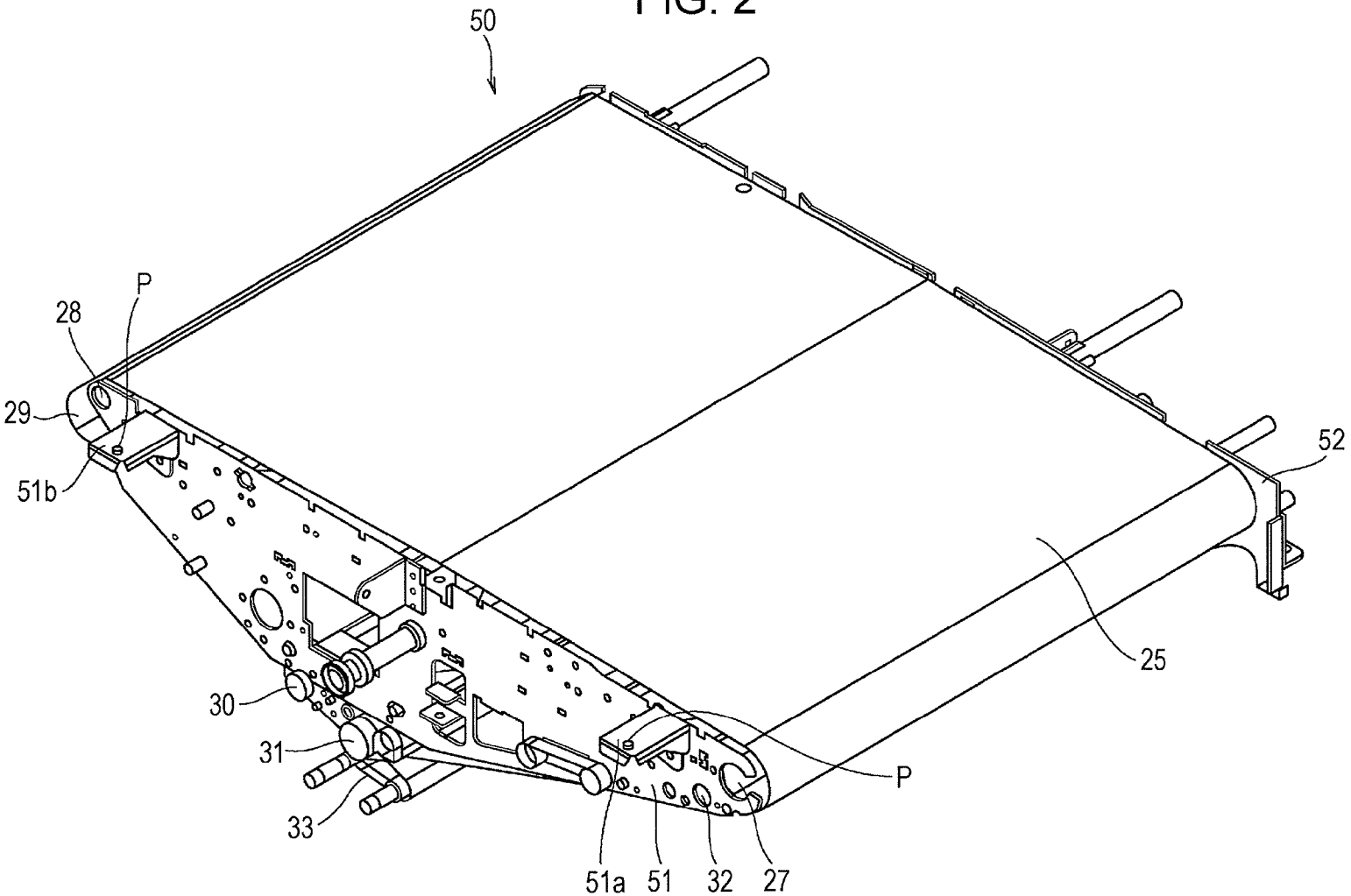
FIG. 2 is a perspective view of an intermediate transfer device to be mounted in the image forming apparatus of FIG. 1.
Figure 3:
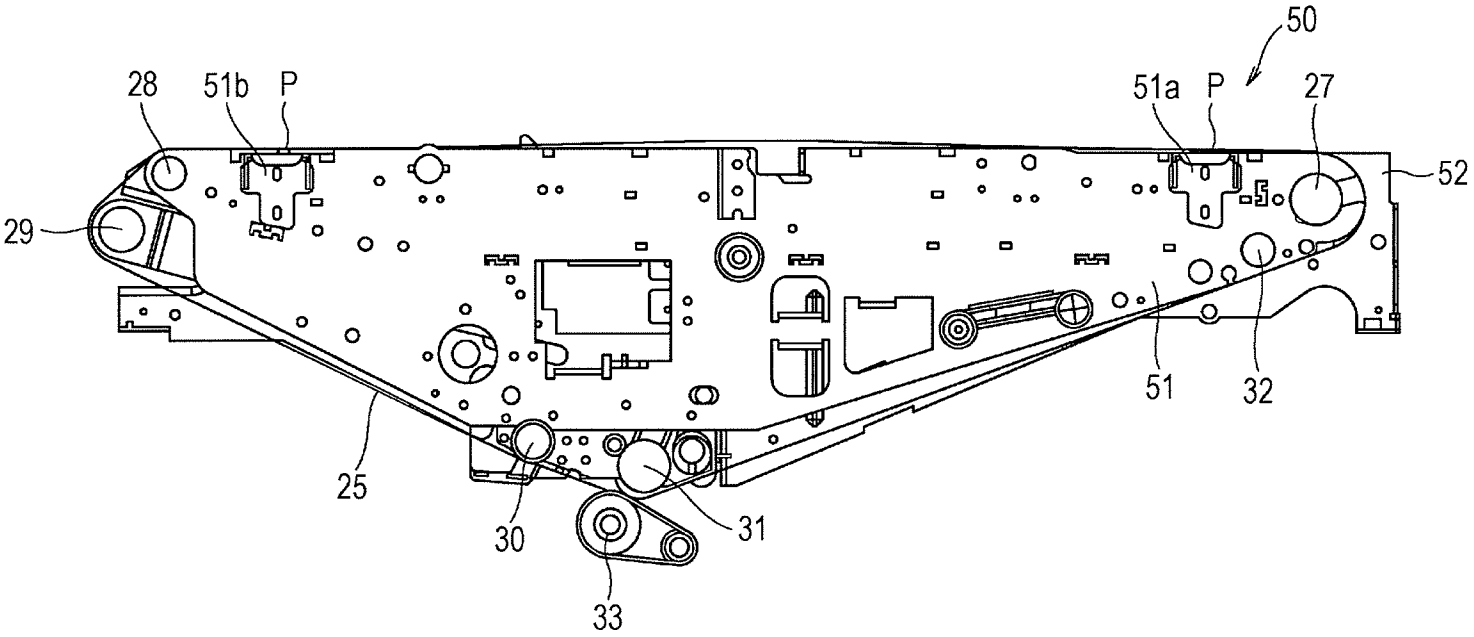
FIG. 3 is a side view of the intermediate transfer device of FIG. 2 seen in a direction in which the intermediate transfer device is inserted into an apparatus body.
Figure 4:
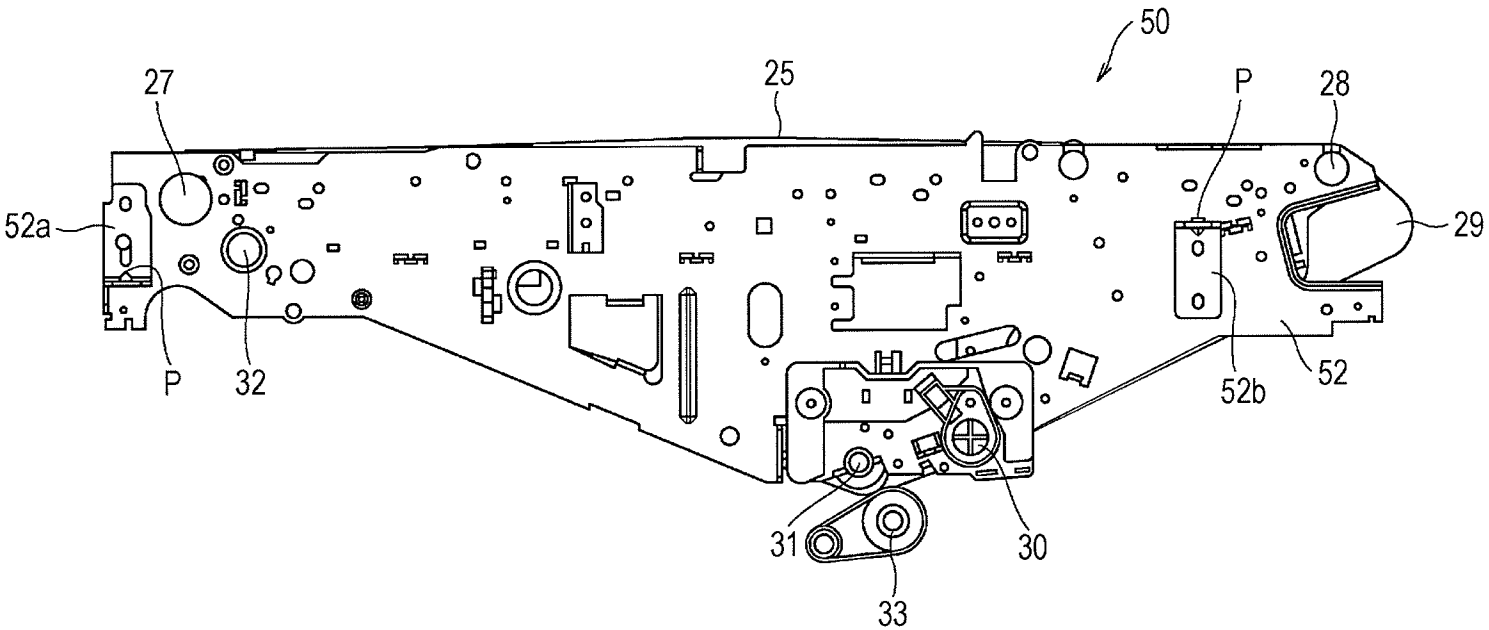
FIG. 4 is a side view of the intermediate transfer device of FIG. 2 seen in a direction opposite to the direction in which the intermediate transfer device is inserted into an apparatus body.
Figure 5:
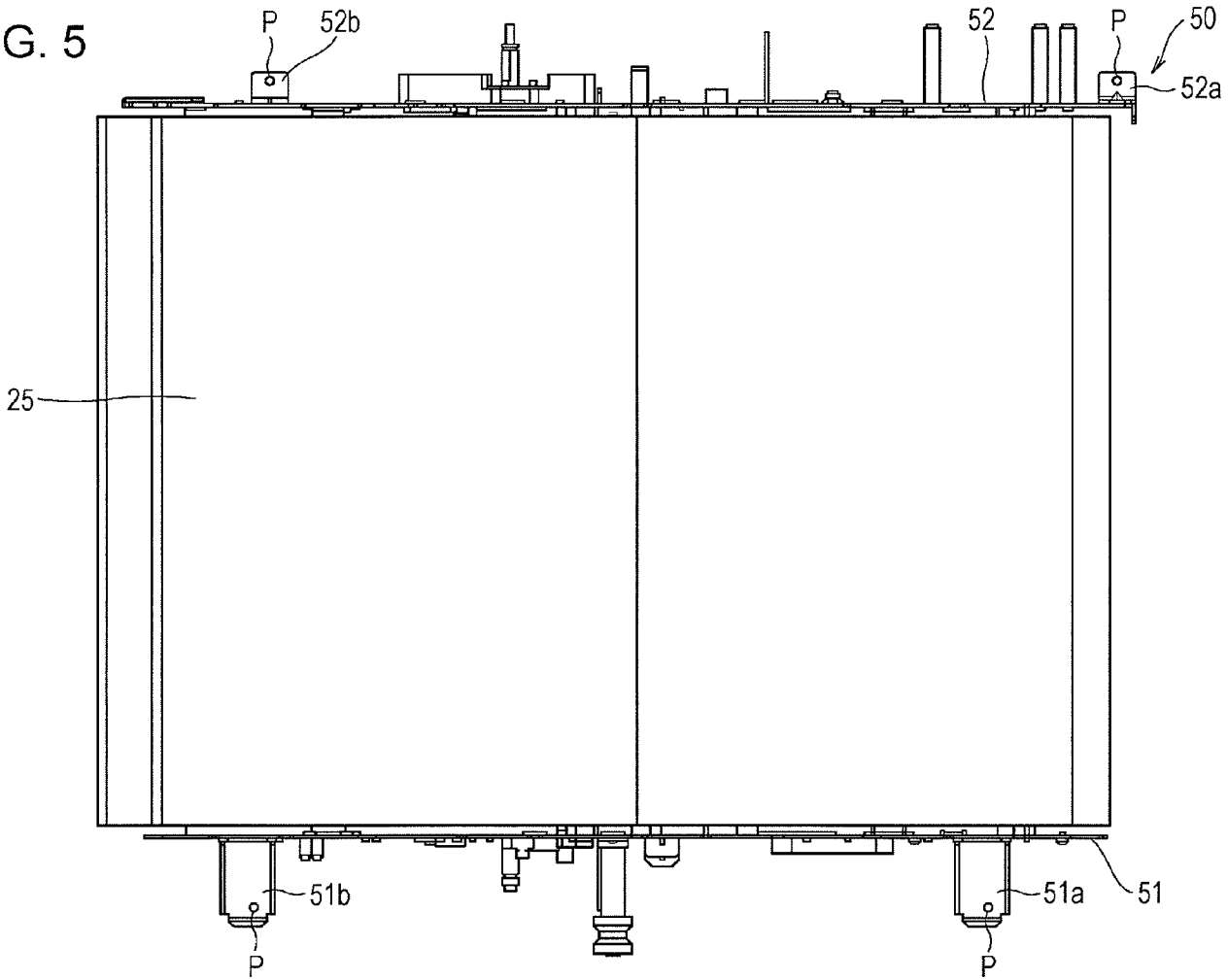
FIG. 5 is a plan view of the intermediate transfer device of FIG. 2.

Hereinafter, an exemplary embodiment according to the present invention will be described with reference to the drawings. In the drawings, the same components will be generally denoted by the same numerals and redundant description of such components will be omitted.

FIG. 1 illustrates a tandem-type digital color copier PR1, which is an example of an image forming apparatus according to an exemplary embodiment of the present invention.

The digital color copier PR1 includes, in an upper end portion thereof, a platen cover 3 that presses a document 2 against a platen glass 5, and an image reading device 4 that reads an image of the document 2 placed on the platen glass 5.

In the image reading device 4, the document 2 placed on the platen glass 5 is irradiated with light emitted from a light source 6. Reflected light from the document 2 is scanned over an image reading element 11, such as a CCD, via a reduction optical system including a full-rate mirror 7, half-rate mirrors 8 and 9, and an imaging lens 10. The image reading element 11 reads a color reflected light image of the document 2 with a predetermined dot pitch.

The color reflected light image of the document 2, which has been read by the image reading device 4, is sent to an image processing device 12 as document reflection-rate data of three colors, such as red (R), green (G), and blue (B). The image processing device 12 performs image processing, such as shading correction, displacement correction, lightness/color-space conversion, gamma correction, frame erasing, and color/movement editing, on the reflection-rate data of the document 2.

The image data, which has been processed by the image processing device 12, is converted to four-color gradation document data (raster data) of yellow (Y), magenta (M), cyan (C), and black (K). As described below, the color gradation document data is sent to exposure devices 14Y, 14M, 14C, and 14K for yellow (Y), magenta (M), cyan (C), and black (K) (which are examples of exposures units and may be collectively referred to as the "exposure devices 14") of image forming units 13Y, 13M, 13C, and 13K. Each of the exposure devices 14 performs image exposure in accordance with the color gradation document data by using a laser beam.

As described above, in the tandem-type digital color copier PR1, the four image forming units 13Y, 13M, 13C, and 13K for yellow (Y), magenta (M), cyan (C), and black (K) (which may be collectively referred to as the "image forming units 13") are arranged in a horizontal direction with a distance therebetween.

The digital color copier PR1 includes an electric circuit 49 including an image processing circuit that performs image processing on an image signal, a high-voltage power supply circuit, and the like.

The four image forming units 13Y, 13M, 13C, and 13K have the same structure and each include a photoconductor drum 15, 15Y, 15M, 15C, and 15K; a charger 16, 16Y, 16M, 16C, and 16K for first charging; the exposure device 14; developing devices 17Y, 17M, 17C, and 17K; and a cleaning device 18. The photoconductor drum 15 is an example of an electrostatic latent image carrier. The intermediate transfer belt 25 rotates in the direction of arrow A with a predetermined rotation speed. The charger 16 (an example of a charging unit) charges the surface of the photoconductor drum 15. The exposure device 14 exposes the color images on the surface of the photoconductor drum 15 to light to form an electrostatic latent image. Each of the developing devices 17Y, 17M, 17C, and 17K (which are examples of developing units and may be collectively referred to as the "developing devices 17") develops the electrostatic latent image formed on the photoconductor drum 15 to form a toner image (an example of a developer image). The cleaning device 18 removes toner that remains on the photoconductor drum 15 after the toner image has been transferred.

The exposure device 14 modulates a semiconductor laser 19 in accordance with the color gradation document data and emits a laser beam LB from the semiconductor laser 19 in accordance with the gradation data. The laser beam LB emitted from the semiconductor laser 19 is reflected by reflection mirrors 20 and 21 and is deflection-scanned by a rotary polygon mirror 22. Then, the laser beam LB is reflected again by the reflection mirrors 20 and 21 and reflection mirrors 23 and 24, and the laser beam LB is scanned over the photoconductor drum 15, which is an example of an electrostatic latent image carrier.

The image processing device 12 successively outputs color image data (raster data) to the exposure devices 14 of the image forming units 13 for yellow (Y), magenta (M), cyan (C), and black (K). The exposure devices 14 emit laser beams LB in accordance with the image data, and the laser beam LB is scanned over the surfaces of the photoconductor drums 15 to form electrostatic latent images.

The developing devices 17 develop the electrostatic latent images, which have been formed on the photoconductor drum 15, into yellow (Y), magenta (M), cyan (C), and black (K) toner images.

An intermediate transfer belt 25, which is an example of an intermediate transfer member, is disposed below the image forming units 13Y, 13M, 13C, and 13K. First transfer rollers 26Y, 26M, 26C, and 26K (examples of first-transfer units) transfer (multi-transfer) the yellow (Y), magenta (M), cyan (C), and black (K) toner images, which have been successively formed on the photoconductor drums 15 of the image forming units 13, to the intermediate transfer belt 25 so as to overlap one another.

The intermediate transfer belt 25 is looped over a belt driving roller 27, a tension roller 28, a tensioner 29, an idle roller 30, a backup roller 31, and an idle roller 32, all of which are examples of intermediate transfer member support members. The belt driving roller 27 is rotated by a driving force transmission roller (not shown). The intermediate transfer belt 25 is rotated in the circumferential direction, which is indicated by arrow A, by the belt driving roller 27 while the tensioner 29 applies a predetermined tension to the intermediate transfer belt 25.

The intermediate transfer belt 25 is, for example, an endless belt made by connecting ends of a strip of a flexible synthetic resin film, such as a polyamide-imide film, to each other by welding or the like.

A second-transfer roller 33 (second-transfer unit) is disposed so as to be in pressed contact with the backup roller 31. The second-transfer roller 33 simultaneously second-transfers the toner images, which are composed of yellow (Y), magenta (M), cyan (C), and black (K) toners and which have been transferred to the intermediate transfer belt 25 so as to overlap one another, to a recording sheet 34, which is an example of a recording medium, with a pressing force and an electrostatic force. The recording sheet 34, to which the color toner images have been transferred, is transported to a fixing unit 37 (an example of a fixing member) by a pair of serially arranged transfer belts 35 and 36.

The fixing unit 37 fixes the color toner images, which have been transferred to the recording sheet 34, to the recording sheet 34 with heat and pressure. The recording sheet 34 is output to an output tray 38 disposed outside of the digital color copier PR1.

As illustrated in FIG. 1, the recording sheet 34 is fed from one of feed trays 39, 40, and 41 through a sheet transport path 46, along which a feed roller 42 and pairs of sheet transport rollers 43, 44, and 45 are arranged; and is transported a pair of registration rollers 47.

The recording sheet 34, which has been supplied from one of the feed trays 39, 40, and 41, is fed onto the intermediate transfer belt 25 by the pair of registration rollers 47, which is rotated with a predetermined timing.

As described above, the four image forming units 13Y, 13M, 13C, and 13K for black, yellow, magenta, and cyan successively form black, yellow, magenta, and cyan toner images.

After the toner images have been transferred from the photoconductor drum 15, the cleaning device 18 removes residual toner, paper dust, and the like from the photoconductor drum 15 so that the next image forming process may be started.

A belt cleaner 48 removes residual toner from the intermediate transfer belt 25.

As illustrated in FIGS. 2 to 5, two frames 51 and 52 (examples of frame members) are disposed at the ends of the intermediate transfer belt 25 in the width direction. The frames 51 and 52 support the ends of each of the belt driving roller 27, the tension roller 28, the tensioner 29, the idle roller 30, the backup roller 31, and the idle roller 32, which are examples of intermediate transfer member support members.

These components are unitized into an intermediate transfer device 50, which is configured to be inserted into and removed from an apparatus body 1.

The frame 51 includes positioning plates 51*a* and 51*b* (examples of first and second positioning members) that are disposed with a distance therebetween. Likewise, the frame 52 includes positioning plates 52*a* and 52*b* (examples of first and second positioning members) that are disposed with a distance therebetween. When the intermediate transfer device 50 is mounted in the apparatus body 1, the positioning plates 51*a*, 51*b*, 52*a*, and 52*b* pressure-contact components of the apparatus body 1 so as to perform positioning. The distance between the positioning plates 51*a* and 51*b* of the frame 51 is smaller than the distance between the positioning plates 52*a* and 52*b* of the frame 52.

Each of the positioning plates 51*a*, 51*b*, 52*a* and 52*b* includes a protrusion P (an example of a positioning portion) that is, for example, cylindrical and oriented upward. When the intermediate transfer device 50 is inserted into the apparatus body 1 and displaced upward (as described below in detail), the protrusions P are fitted into positioning holes (not shown) formed in parts of the apparatus body 1 and thereby displacement of the intermediate transfer device 50 in horizontal directions is restricted. Moreover, as the intermediate transfer device 50 is displaced upward, the positioning plates 51*a*, 51*b*, 52*a* and 52*b* are pressed against the components of the apparatus body 1 and thereby the position of the intermediate transfer device 50 in the vertical direction is restricted.

Figure 6:
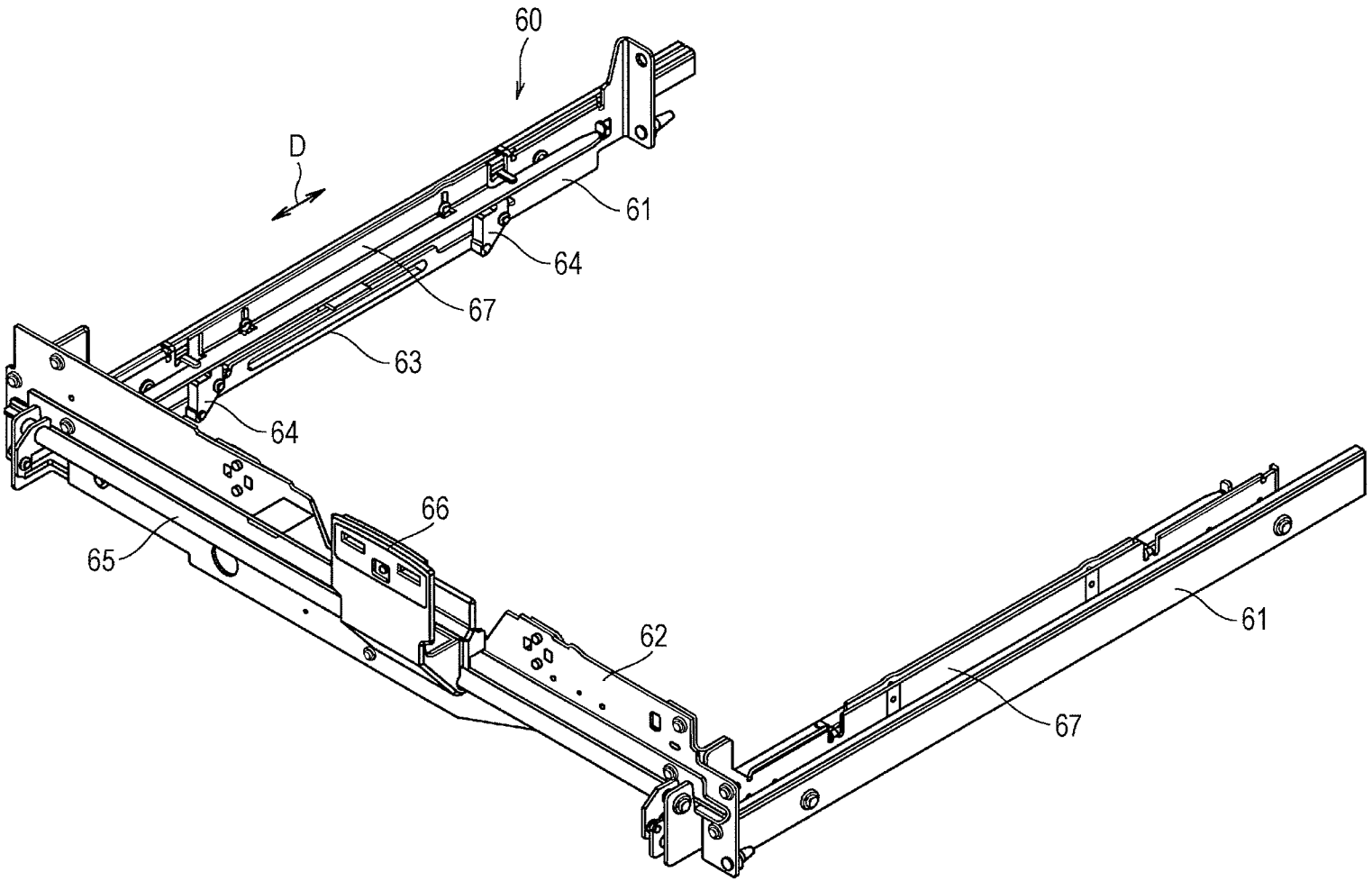
FIG. 6 is a perspective view of a removable mounting member that is used when inserting the intermediate transfer device of FIG. 2 into the apparatus body.

The intermediate transfer device 50 having the structure described above is mounted on a removable mounting member 60 illustrated in FIG. 6 and is inserted into and mounted in the apparatus body 1.

The removable mounting member 60 illustrated in FIG. 6 is substantially angular U-shaped in plan view. The removable mounting member 60 includes a pair of side frames 61 and a front frame 62. Rotary cams 64 are attached to each of the side frames 61. Each of the ends of the front frame 62 is connected to a corresponding one of the side frames 61. A slider 63 is rotatably connected to the rotary cams 64 at positions that are different from those of the rotation centers of the rotary cams 64. A handle shaft 65 and a handle 66 are disposed on the front frame 62. The handle shaft 65 is connected to the slider 63 through a link mechanism, and the handle 66 is used to rotate the handle shaft 65. The side frames 61 of the removable mounting member 60 are inserted into guide rails (not shown) disposed in the apparatus body 1 so as to be moved back and forth along the guide rails in insertion/removal directions D.

When the handle 66 is raised, the handle shaft 65 is rotated, the slider 63 is slid, the rotary cams 64 rotate so as to be in upright positions, and thereby a base 67 placed on the side frame 61 is moved upward. When the handle 66 is pulled down, the rotary cams 64 rotate so as to be lowered and the base 67 is moved downward.

The intermediate transfer device 50 is mounted on the base 67 of the removable mounting member 60, which has the structure described above, such that the axial direction of the rollers 27 to 31 coincides with the insertion/removal directions D indicated by the arrows in FIG. 6 and such that the frame 51 faces forward in FIG. 6.

When the removable mounting member 60 is pushed into the apparatus body 1 along the guide rails and the handle 66 is raised, the rotary cams 64 are rotated, and thereby the base 67 and the removable mounting member 60 are displaced upward. Thus, the intermediate transfer device 50 is inserted into and mounted in the apparatus body 1 such that the position of the intermediate transfer device 50 is restrained in horizontal directions and in the vertical direction.

Here, the inventors examine the factors that contribute to the strain in the frames 51 and 52. To be specific, the positional relationship among a pressing force applied by the second-transfer roller 33 and the positioning plates 51*a*, 51*b*, 52*a* and 52*b* of the frames 51 and 52 is analyzed.

Figure 7:
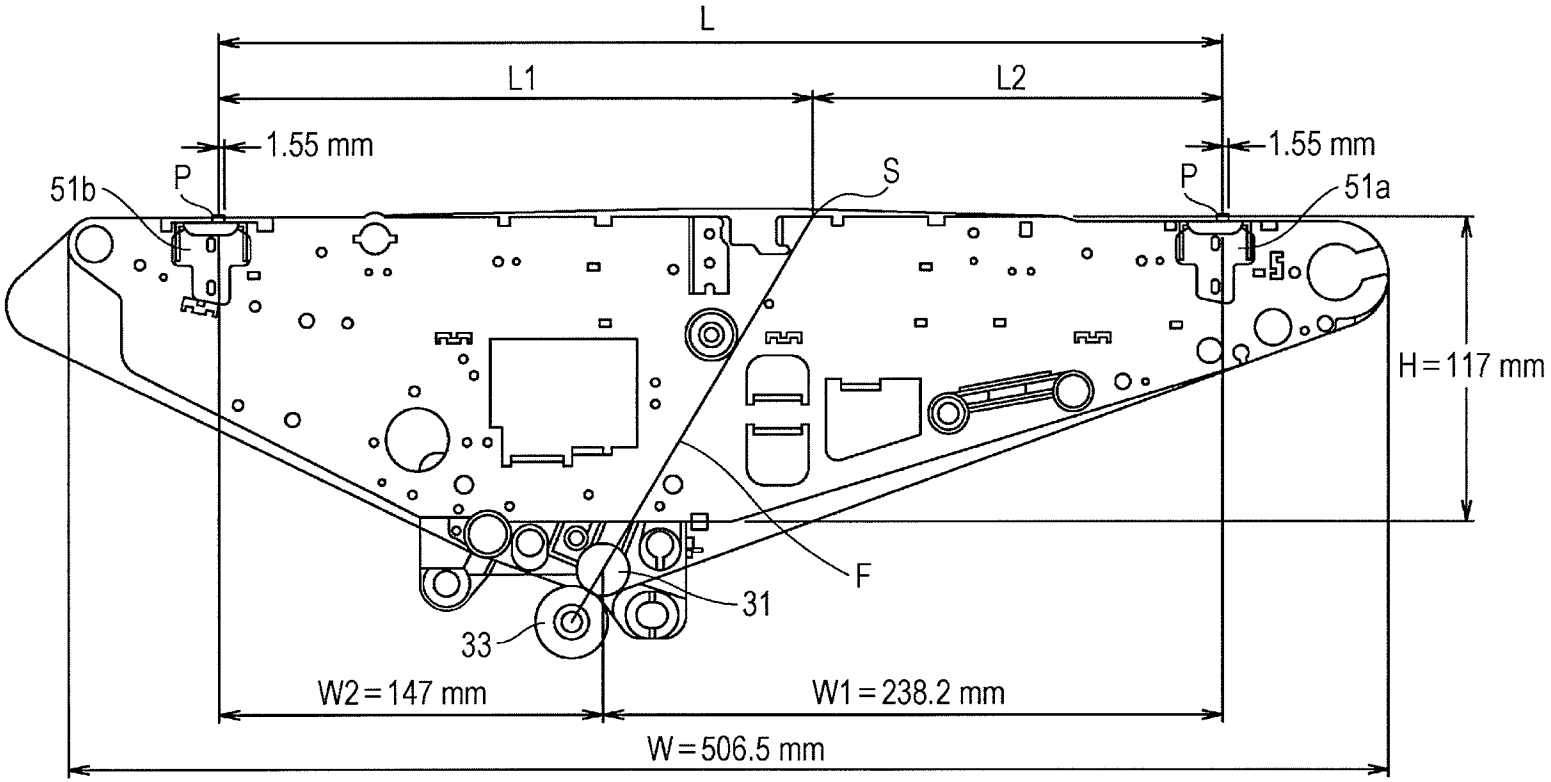
FIG. 7 illustrates a frame of the intermediate transfer device of FIG. 2.

The material of the frames 51 and 52 is a chrome-free steel plate having a thickness of 1.6 mm. As illustrated in FIG. 7, the dimensions of the frame 51 are as follows: the height H=117 mm, the width W=506.5 mm, the diameter of the protrusion P formed in each of the positioning plates 51*a* and 51*b*=1.55 mm, the distance W1 between the backup roller 31 and the protrusion P of the positioning plate 51*a* in the width direction=238.2 mm, and the distance W2 between the backup roller 31 and the protrusion P of the positioning plate 51*b* in the width direction=147 mm.

The amount of strain in the frame 51 having such dimensions is observed while changing the position of the positioning plate 51*a*. That is, the ratio of a length L1 and a length L2 defined as described below is calculated. Here, L is the length of a line segment connecting the protrusion P of the positioning plate 51*a* to the protrusion P of the positioning plate 51*b*; S is an intersection point of the line segment having the length L and a line of action F of a force (nip pressure) applied to the frame 51 by the second-transfer roller 33; L1 is the length of a line segment connecting the intersection point S to the protrusion P of the positioning plate 51*b*, which is located on a side opposite to a side toward which the line of action F is inclined; and L2 is the length of a line segment connecting the intersection point S to the protrusion P of the positioning plate 51*a*, which is located on the side toward which the line of action F is inclined. The nip pressure is set at 72 N.

FIGS. 8 to 14 illustrate the observation result of the amount of strain in the frame 51 when the position of the protrusion P of the positioning plate 51*a* is changed.

Figure 8:
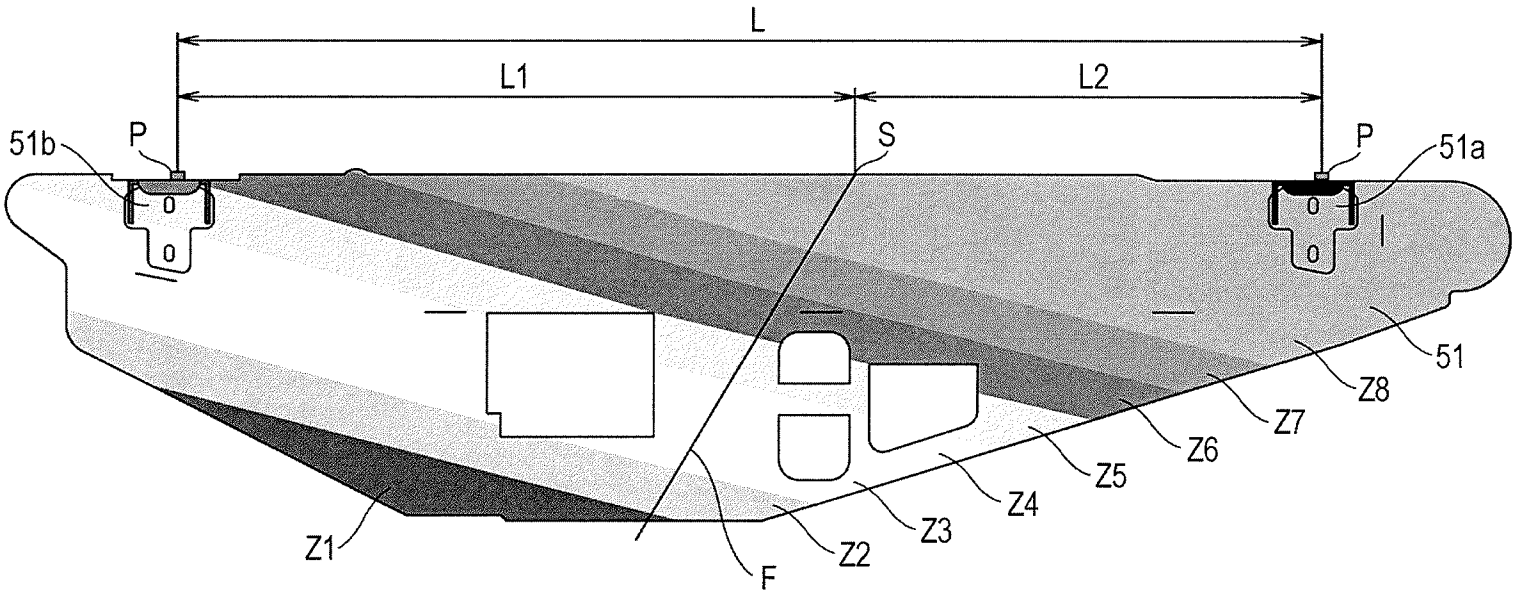
FIG. 8 illustrates an observation result of the amount of strain in the frame of FIG. 7 when a protrusion of a positioning plate is located at an exemplary position.
Figure 9:
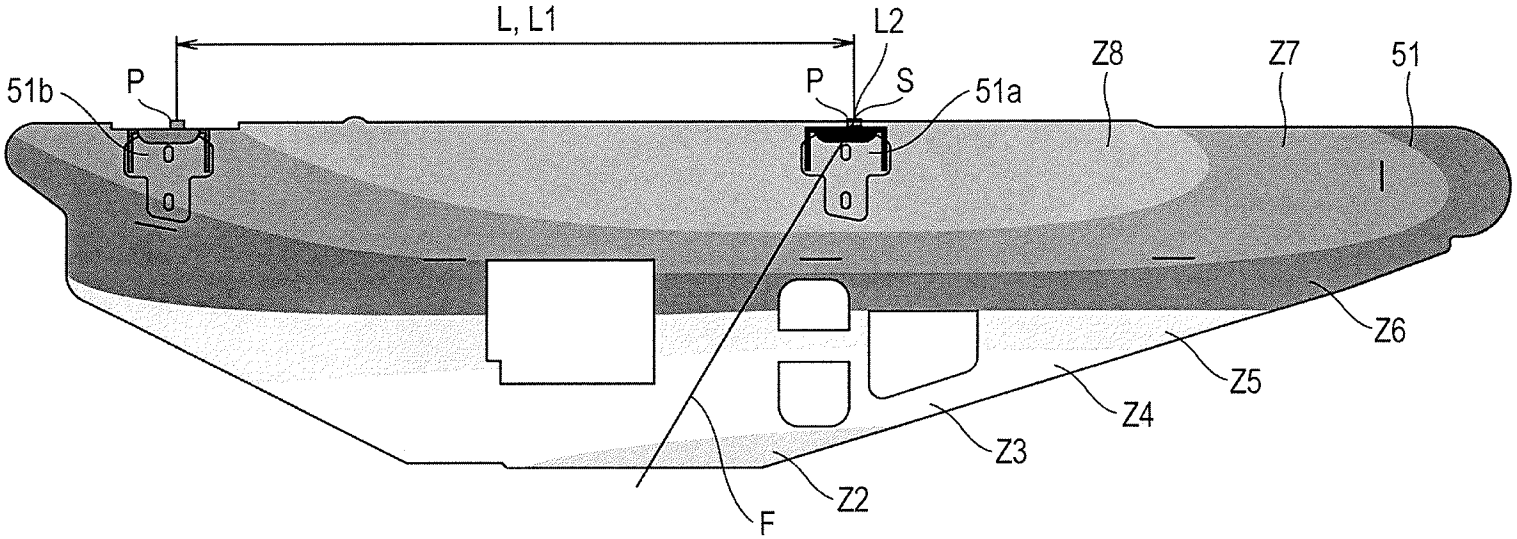
FIG. 9 illustrates an observation result of the amount of strain in the frame of FIG. 7 when the protrusion of the positioning plate is located at another exemplary position.
Figure 10:
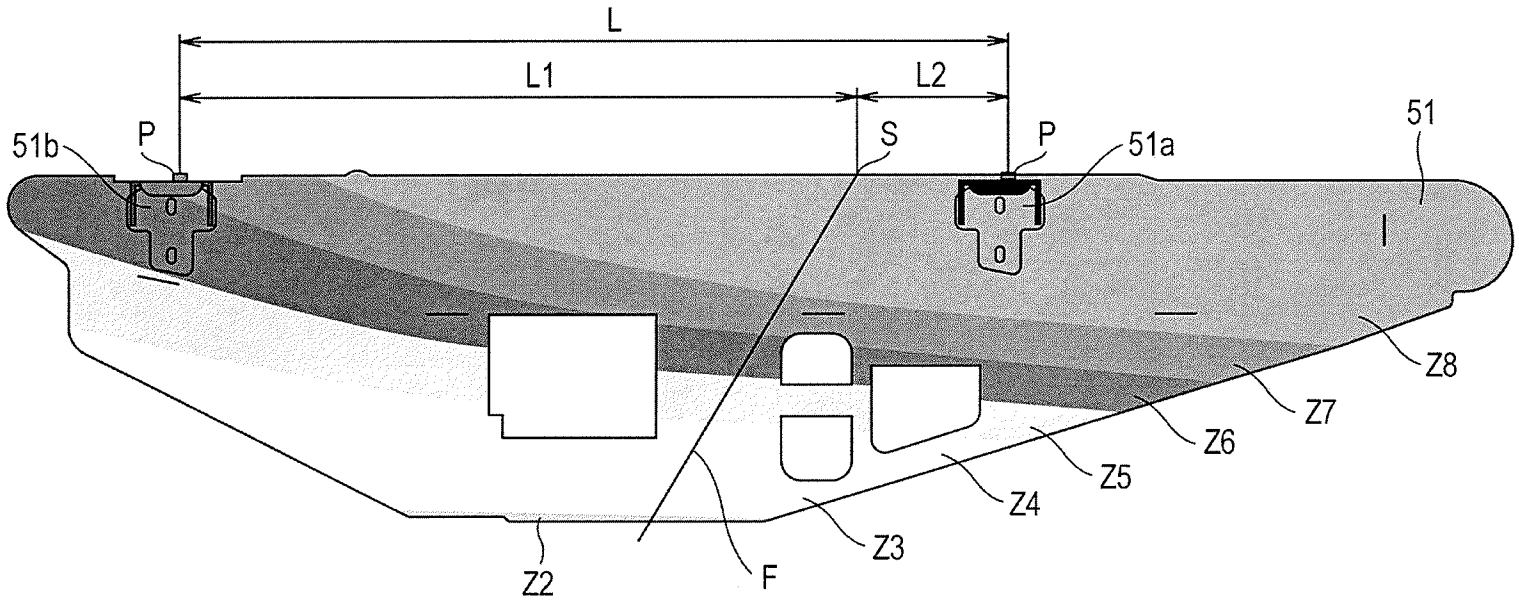
FIG. 10 illustrates an observation result of the amount of strain in the frame of FIG. 7 when the protrusion of the positioning plate is located at another exemplary position.
Figure 11:
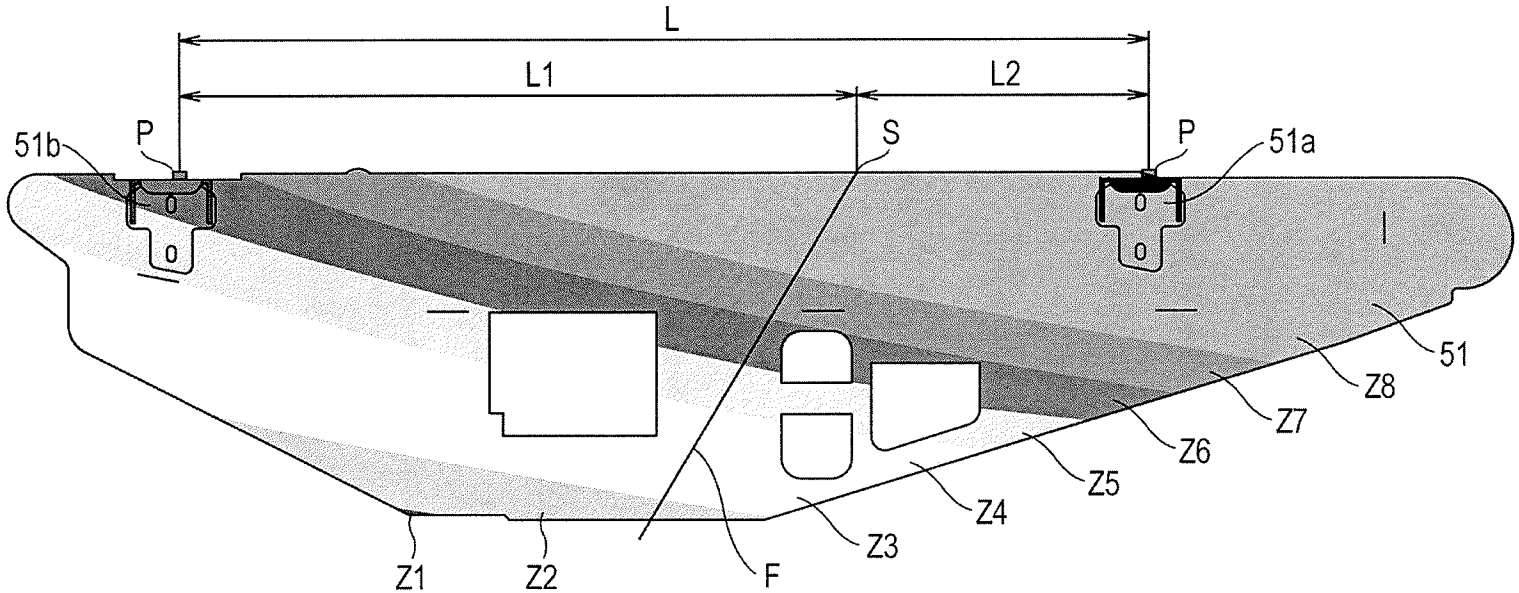
FIG. 11 illustrates an observation result of the amount of strain in the frame of FIG. 7 when the protrusion of the positioning plate is located at another exemplary position.
Figure 12:
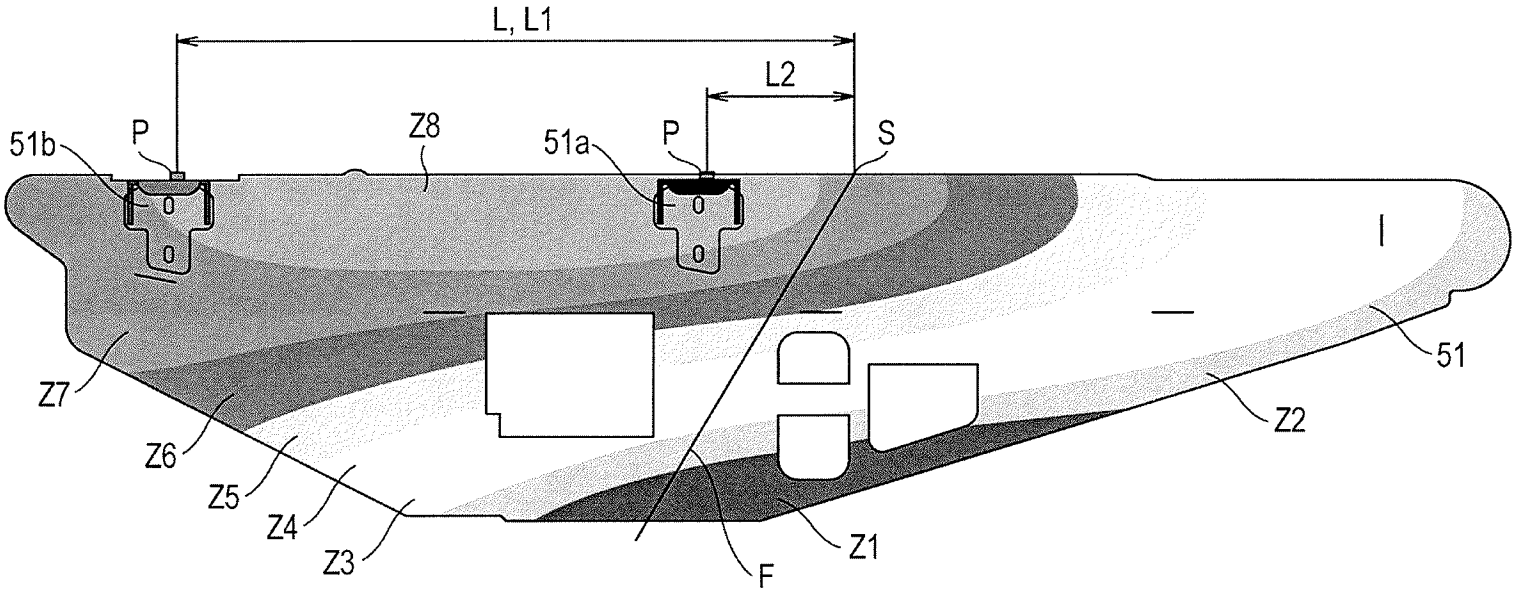
FIG. 12 illustrates an observation result of the amount of strain in the frame of FIG. 7 when the protrusion of the positioning plate is located at another exemplary position.
Figure 13:
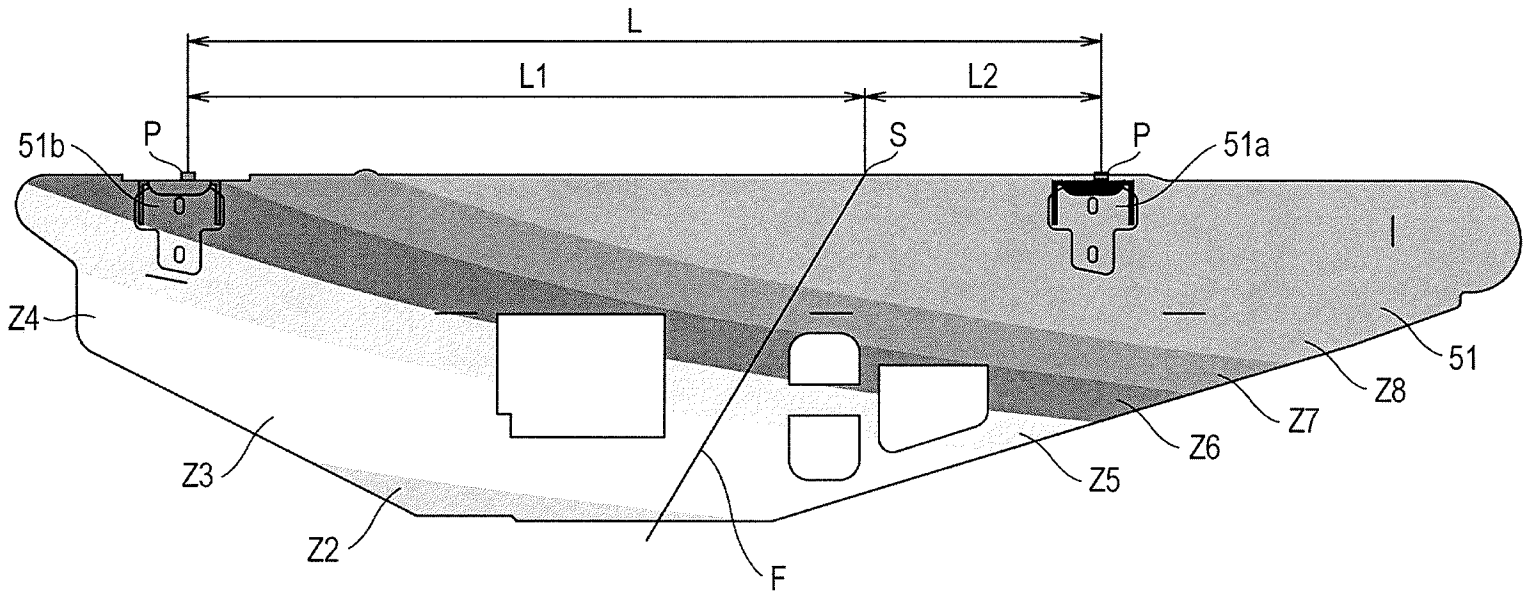
FIG. 13 illustrates an observation result of the amount of strain in the frame of FIG. 7 when the protrusion of the positioning plate is located at another exemplary position.
Figure 14:
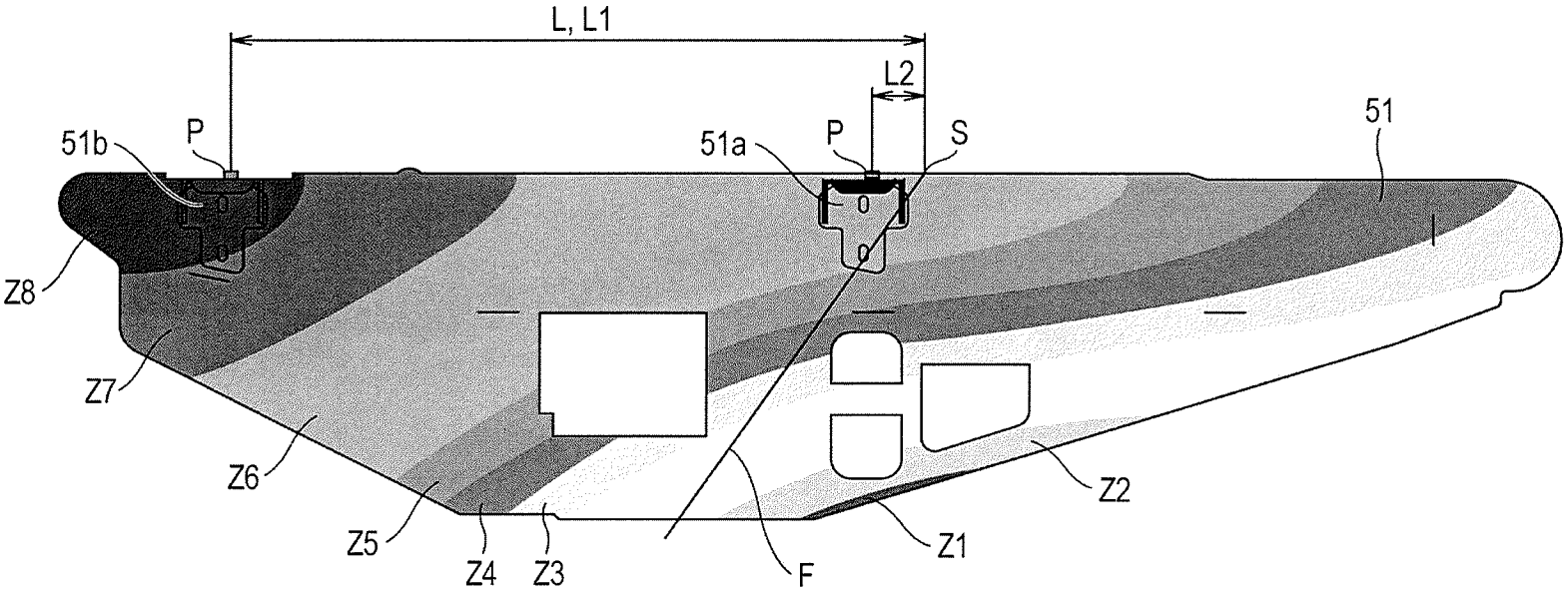
FIG. 14 illustrates an observation result of the amount of strain in the frame of FIG. 7 when the protrusion of the positioning plate is located at another exemplary position.

In FIG. 8, L=388 mm, L1=228 mm, and L2=160 mm. In FIG. 9, L=L1=228 mm, and L2=0 mm. In FIG. 10, L=278 mm, L1=228 mm, and L2=50 mm. In FIG. 11, L=328 mm, L1=228 mm, and L2=100 mm. In FIG. 12, L=L1=228 mm, and L2=−50 mm. In FIG. 13, L=308 mm, L1=228 mm, and L2=80 mm. In FIG. 14, L=L1=228 mm, and L2=−10 mm.

A numeral Z1 indicates a region in which the amount of strain is equal to or larger than 0.73 mm, a numeral Z2 indicates a region in which the amount of strain is in the range of 0.67 to 0.73 mm, a numeral Z3 indicates a region in which the amount of strain is in the range of 0.60 to 0.67 mm, a numeral Z4 indicates a region in which the amount of strain is in the range of 0.53 to 0.60 mm, a numeral Z5 indicates a region in which the amount of strain is in the range of 0.47 to 0.53 mm, a numeral Z6 indicates a region in which the amount of strain is in the range of 0.40 to 0.47 mm, a numeral Z7 indicates a region in which the amount of strain is in the range of 0.33 to 0.40 mm, and a numeral Z8 indicates a region in which the amount of strain is equal to or smaller than 0.33 mm.

In FIGS. 8, 11, 12, and 14, the amount of strain is large (i.e. there is a region indicated by numeral Z1, in which the amount of strain is equal to or larger than 0.73 mm). In FIGS. 9, 10, and 13, the amount of strain is small (i.e. there is not a region indicated by numeral Z1, in which the amount of strain is equal to or larger than 0.73 mm).

As is seen from these results, the amount of strain in the frame 51 is small when L2 is equal to or smaller than 80 mm. Although the amount of strain is small when L2 is equal to or larger than 0 mm, the amount of strain increases sharply when L2 becomes negative, i.e. when the position of the protrusion P of the positioning plate 51*a* is between the intersection point S and the positioning plate 51*b*. This corresponds to a condition L1:L2=228 mm:0-80 mm, i.e., L1:L2=2.85:x ($0 \le x \le 1$).

Therefore, when the frame 51 satisfies this condition, the strain is restrained. By using the frame 51 that satisfies this condition, the positional relationship between the intermediate transfer belt 25 and the photoconductor drum 15 is maintained appropriately and a high quality image forming operation is performed.

As illustrated in FIGS. 2 to 5, in the exemplary embodiment, the distance between the positioning plates 51*a* and 51*b* of the frame 51 is different from the distance between the positioning plates 52*a* and 52*b* of the frame 52. In such a case, it is sufficient that one or both of the frames 51 and 52 satisfy the aforementioned condition.

Heretofore, an exemplary embodiment according to the invention achieved by the inventors has been described. However, the exemplary embodiment described in the present specification is an example in all respects and is not limited to the technologies disclosed herein.

For example, the dimensions of the frames 51 and 52 in the exemplary embodiment are only examples, and the frames 51 and 52 may have any dimensions as long as the condition L1:L2=2.85:x ($0 \le x \le 1$) is satisfied.

In the exemplary embodiment described above, the image forming apparatus performs recording by using four color developers, i.e., yellow, magenta, cyan, and black developers. However, the number of colors and the colors of the developers are not limited to those of the exemplary embodiment.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An intermediate transfer device comprising:

an endless intermediate transfer member to which a plurality of developer images in different colors are transferred so as to overlap one another by a first-transfer unit;

a plurality of intermediate transfer member support members that support the intermediate transfer member so that the intermediate transfer member rotates in a circumferential direction;

two frame members respectively disposed at two ends of the intermediate transfer member in a width direction of the intermediate transfer member, the two frame members supporting two ends of each of the intermediate transfer member support members; and first and second positioning members respectively disposed at two positions on each of the frame members with a distance therebetween, each of the first and second positioning members including a positioning portion that performs positioning by pressure-contacting an apparatus body when the intermediate transfer device is mounted in the apparatus body, wherein at least one of the frame members satisfies a condition L1:L2 =2.85:x ($0 \le x \le 1$), where L1 is a length of a line segment connecting an intersection point to the positioning portion of one of the first and second positioning members that is located on a side opposite to a side toward which a line of action of a force applied to the at least one of the frame members is inclined and L2 is a length of a line segment connecting the intersection point to the positioning portion of the other of the first and second positioning members that is located on the side toward which the line of action is inclined, the intersection point being an intersection of the line of action and a line segment connecting the two positioning portions to each other, the force being applied by a second-transfer unit that transfers the developer images on the intermediate transfer member to a recording medium by pressing one of the intermediate transfer member supporting members with the intermediate transfer member therebetween.

2. An image forming apparatus comprising:

a plurality of electrostatic latent image carriers provided so as to correspond to a plurality of colors, the electrostatic latent image carriers carrying electrostatic latent images formed on the basis of image information;

a plurality of developing units provided so as to correspond to the plurality of electrostatic latent image carriers, the developing units developing the electrostatic latent images formed on surfaces of the electrostatic latent image carriers into developer images by using developers;

the intermediate transfer device according to claim 1;

a plurality of first-transfer units provided so as to correspond to the plurality of electrostatic latent image carriers, the first-transfer units transferring the developer images on the electrostatic latent image carriers to the intermediate transfer member so as to overlap one another;

the second-transfer unit that transfers the developer images on the intermediate transfer member to the recording medium; and a fixing unit that fixes the developer images, which have been transferred to the recording medium, to the recording medium.

* * * * *